US005607069A

United States Patent [19]

Stroobants et al.

[11] Patent Number: 5,607,069

[45] Date of Patent: Mar. 4, 1997

[54] PAINTING FIXTURE WITH MODULAR CROSSBARS

[75] Inventors: Steven P. Stroobants; Marvin J. Stroobants; Douglas J. Schulz, all of Chilton, Wis.

[73] Assignee: Thermal Clean, Inc., Chilton, Wis.

[21] Appl. No.: 536,095

[22] Filed: Sep. 29, 1995

[51] Int. Cl.[6] ..... A47F 5/00

[52] U.S. Cl. ..... 211/113; 204/297 W; 118/500; 211/118

[58] Field of Search ..... 211/113, 118, 211/119; 118/500; 204/297 W

[56] References Cited

U.S. PATENT DOCUMENTS

| | | | |
|---|---|---|---|
| 2,462,431 | 2/1949 | Schneider | 204/297 W X |
| 2,858,266 | 10/1958 | Schneider | 204/297 W |
| 3,366,567 | 1/1968 | Elbaum | 204/297 W |
| 4,037,727 | 7/1977 | Kunkle | 204/297 W X |
| 4,770,303 | 9/1988 | Boyd | 211/118 X |
| 5,147,050 | 9/1992 | Cullen | 204/297 W X |

*Primary Examiner*—Robert W. Gibson, Jr.
*Attorney, Agent, or Firm*—Michael, Best & Friedrich

[57] ABSTRACT

The invention includes a rack assembly for use in supporting articles for processing, cleaning, painting and paint stripping, the rack assembly being comprised of modular components which can be conveniently assembled. The modular components can be assembled in various patterns depending on the shape of the articles to be painted and can be conveniently and compactly stored when not in use.

23 Claims, 2 Drawing Sheets

10
12
14
16
18
20
22
24
26
30
32
40
44
46
48
110
112
116

PAINTING FIXTURE WITH MODULAR CROSSBARS

FIELD OF THE INVENTION

The invention relates to hangers and fixtures for supporting articles for processing, cleaning, painting and paint stripping and more particularly to hangers and fixtures which can be cleaned following a painting or processing operation and which can be disassembled for movement and storage.

BACKGROUND PRIOR ART

Painting or other processing of small articles during a manufacturing process commonly requires that the small articles be hung on a rack or hangers and then conveyed through a painting or other operation. During a painting operation, the articles can be either dipped in paint or spray painted. The articles are often conveyed through a washing or cleaning operation prior to the painting operation and then also through a drying operation following the paint application.

Painting operations also frequently require that the article to be painted be electrostatically charged to provide for uniform adherence of paint to the articles. This is accomplished by connecting articles to a source of electrical energy such that the articles become electrically charged.

Following the painting operation, the racks or hangers are cleaned and stripped of paint. The hangers or racks may be cleaned in the manufacturing operation or in some cases are shipped to another location for removal of paint.

Prior art racks and hangers used in painting operations have been bulky and require a significant amount of manufacturing area for storage both prior to the painting operation and after the operation. They can be also be expensive to transport for cleaning or paint removal, and due to the configuration of these racks or hangers they become tangled in storage and can be difficult to separate for use.

SUMMARY OF THE INVENTION

The invention provides an improved rack assembly for use in supporting articles for processing, cleaning, painting, paint removal and transportation of the rack assembly being comprised of modular components which can be conveniently assembled. The modular components of the rack assembly can be assembled in various patterns depending on the shape of the articles to be painted. The modular components can be conveniently and compactly stored when not in use and also are designed so that they can be readily disassembled following the painting operation even when they are coated with paint.

When disassembled the components can be placed on a storage rack in a compact arrangement for storage or for shipment to another location for paint removal.

When the modular components are positioned on the storage rack, they are also conveniently accessible to permit assembly of the components to be used in the painting operation. The selected components to be used can be easily removed from the storage rack and can be assembled in a pattern as required to form a rack assembly.

Referring more particularly to the modular components used to form the rack assembly, they include a stem which comprises a vertical rod and includes one end adapted to be hung on a supporting rack or conveyor. A plurality of sockets are fixed to the stem and spaced apart along its length, and are intended to removably support a crossbar. The sockets each include a central bore which opens upwardly. The sockets are each adapted to receive a key which extends downwardly from a crossbar. Each of the crossbars includes a plurality of hooks depending from the crossbars in a spaced apart relation along the length of the crossbars. The hooks are intended to support articles for painting. The configuration of the bores of the sockets and the cross-sectional configuration of the keys are such that the crossbars are not rotatable with respect to the stem when the keys are housed in the sockets.

In a preferred form of the invention each of the crossbars includes one end defining a hook such that when the crossbars are removed from the stem, the crossbars can be hung on a rack for storage.

The rack assembly also includes masking inserts which can be selectively housed in those sockets which are not supporting crossbars. The masking inserts are intended to shield the sockets from the application of paint during a painting operation.

The invention also includes a storage rack for supporting the stems and crossbars for storage and for paint removal.

One of the advantages of the rack assembly of the invention is that the crossbars and key design are supported on the stem by the sockets such that the crossbars are easily removable from the stem even if the stem and crossbars are coated with paint. The socket and key configuration also holds the crossbar firmly with respect to the stem when the crossbars are mounted on the stem and such that the crossbars will not move relative to one another and with respect to the stem.

Another advantage of the invention is that the rack assembly provides a storage mechanism for the stem and crossbars such that they do not become tangled during storage. The stems and crossbars are easy to hang on the storage rack and also to remove from the storage rack for assembly.

Another advantage of the invention is that the configuration of the crossbar hooks prevents articles from falling off the hooks during the washing operation and the painting operation.

Another advantage of the invention is that the storage system substantially reduces the space required for storage of the hanger assemblies since a large number of hanger assemblies can be stored in a relatively compact space.

Another advantage of the invention is that the hooks are connected to crossbars in a manner which permits damaged hooks to be removed from the crossbars and easily replaced.

BRIEF DESCRIPTION OF THE DRAWINGS

FIG. 7 is a perspective view of a storage rack assembly for use in storing and conveying the modular components of the hanger assemblies and illustrating a stem and crossbar supported on the storage rack assembly.

DESCRIPTION OF THE PREFERRED EMBODIMENT

Figures 1, 2, 3, 8:
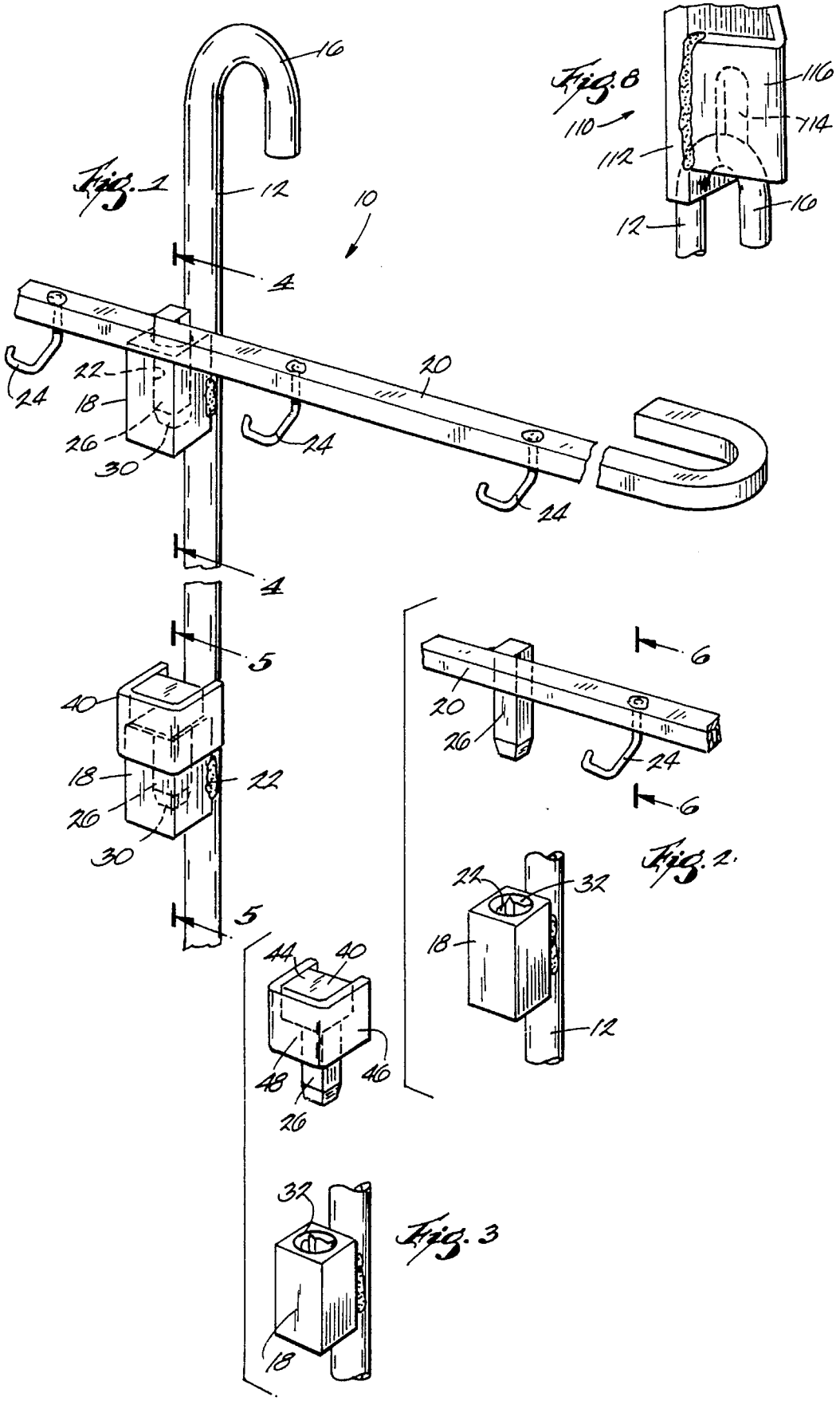
FIG. 1 is a perspective view of a hanger assembly embodying the invention.
FIG. 2 is an exploded partial view of the hanger assembly shown in FIG. 1 and showing the engagement between the key of the hanger assembly and the socket of the stem.
FIG. 3 is an exploded view of a masking insert and socket shown in FIG. 1.
FIG. 8 is a perspective view of a stem hanger bracket embodying the invention and supporting the hook of a stem shown in FIG. 1.
Figure 1:
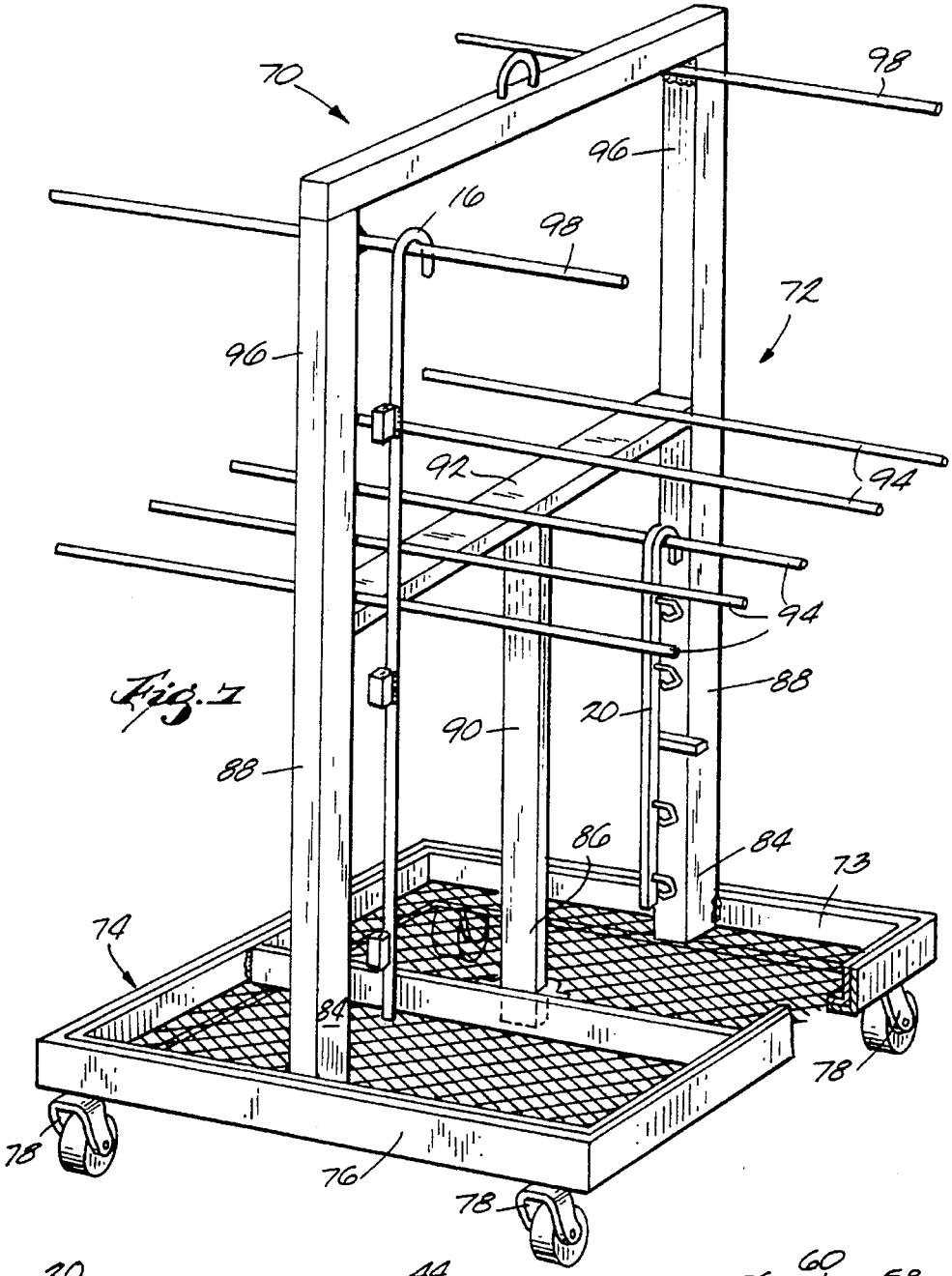

Illustrated in FIG. 1 is a hanger assembly 10 embodying the invention and including a hanger stem 12 adapted to be suspended or otherwise supported vertically by a conveyor or by a fixture for movement through a painting operation. In the illustrated arrangement the hanger stem 12 includes an upper end defining a hook 16 such that the stem 12 can be suspended from the conveyor.

The hanger stem 12 also includes a plurality of sockets 18 fixed to the stem 12 in spaced relation along the length of the stem 12 and each adapted to removably support a crossbar 20. Each socket 18 includes a central bore 22 having a vertically extending longitudinal axis, and the bore 22 having a non-circular cross-section. In the illustrated arrangement the bore 22 of each of the sockets 18 is square in cross-section but other non-circular configurations could be used. While the sockets 18 could be fixed to the stem 12 in other ways, in the illustrated arrangement, the sockets 18 are welded to the stem 12.

The hanger assembly 10 also includes a plurality of crossbars 20 which can be removably supported on the stem 12 by the sockets 18. While in FIG. 1, only one crossbar 20 is shown, in other arrangements the stem 12 could support a plurality of crossbars 20, with each socket 18 or selected ones of the sockets 18 of the stem 12 supporting a crossbar 20. The number of crossbars 20 supported by the stem 12 can be varied depending upon the size of the articles to be painted and the number of articles to be painted. Each crossbar 20 comprises an elongated bar supporting a plurality of article supporting hooks 24 which are spaced apart along the length of the crossbar 20 and which extend downwardly from the crossbar.

Figure 4:
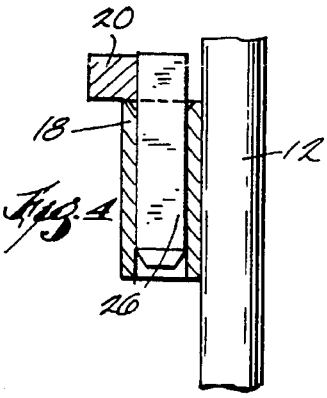
FIG. 4 is a cross-sectional view taken along line 4—4 in FIG. 1.

The crossbars 20 also each include a key 26 fixed to a central portion of the crossbar, i.e., intermediate the opposite ends of the crossbar. The key 26 projects downwardly from a rearward surface of the crossbar 20. The key 26 comprises a vertically extending pin adapted to extend downwardly into the bore 22 of the socket 18 as shown in FIGS. 1 and 4 and to be freely slidably upwardly removable from the socket 18. The key 26 has a cross-sectional configuration complementary to the cross-sectional configuration of the bore 22 of the socket 18 and is slightly smaller in cross-sectional dimension than the bore of the socket such that the key 26 is freely slidable into and out of the socket 18 while also preventing relative pivotal or rocking movement of the crossbar 20 with respect to the stem 12 or with respect to other crossbars 20 supported on the stem 12.

In a preferred form of the invention the lower end of the key 26 includes beveled surfaces 30 and the upper end of the bore 22 of the socket similarly has a beveled opening 32 (FIGS. 2 and 3) to facilitate insertion of the key 26 into the socket 18.

The crossbar 20 also includes one end which is bent so as to form a hook 28. The hooked end 28 of the crossbar 20 functions to provide a means for hanging the crossbar 20 on a storage rack as is illustrated in FIG. 7 when the crossbar 20 is removed from the stem 12. The hook 28 functions to facilitate compact storage of the modular components of the hanger assembly and also facilitates cleaning or paint removal of the hanger assembly components.

The hanger assembly 10 also includes masking inserts 40 which can be housed in the sockets 18 to prevent the sockets 18 from being plugged with paint during the painting operation. Each masking insert 40 includes a key or pin 26 having a configuration the same as the keys fixed to the crossbars.

Figure 5:
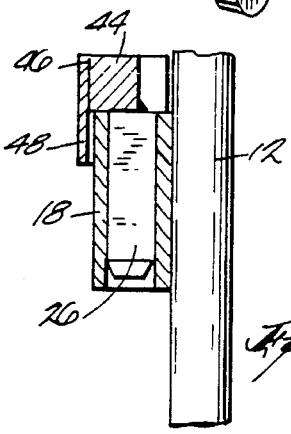
FIG. 5 is a cross-sectional view taken along line 5—5 in FIG. 1.

The masking insert 40 also includes a head 44 fixed to the top of a key 26 and adapted to be supported against the top of the socket 18. The masking insert 40 also includes a channel shaped shield 46 surrounding the front and sides of the head 44 and including a downwardly extending skirt portion 48 intended to surround the three sides of the upper portion of the socket 18 when the masking insert 40 is housed in the socket 18. As best shown in FIG. 5, the skirt portion 48 of the shield 46 is spaced outwardly of the upper end of the socket 18 to facilitate insertion and removal of the masking insert 40 into the socket 18 yet provide a shield for the upper end of the socket to prevent application of paint to this portion of the socket.

Figure 6:
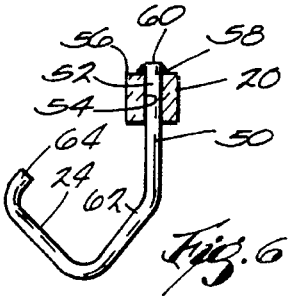
FIG. 6 is a cross-sectional view taken along line 6—6 in FIG. 2.

As best shown in FIG. 6, the hooks 24 extending downwardly from the crossbar 20 each include a vertical portion 50 having an upper end 52 housed in a bore 54 provided in the crossbar 20. A portion of the end 52 of the hook 24 extends upwardly through the bore 54 and is welded to the top surface 56 of the crossbar 20. In the event a hook 24 is damaged or broken and requires replacement, the weld 58 and upper end portion 60 of the hook 24 above the top surface 56 can be ground off and the old hook 24 can then be pulled out of the bore 54 in the crossbar. A new hook 24 can then be inserted into the bore 54 and welded into place as shown in FIG. 6. In a preferred form of the invention, the hooks 24 will include a V-shaped lower portion 62 supported by vertical portion 50 for supporting an article, and a bent end portion 64 extending from the cantilevered end of the hook and toward the crossbar 20. This bent projecting end portion 64 of the hook is bent so as to function to prevent articles hanging from the hook 24 from slipping off the hook either during a washing operation or the painting operation, yet permit easy attachment of an article to the hook when the articles are being placed on the hooks.

FIG. 7 illustrates a storage rack 70 which can be used to store the modular components of the hanger assemblies when they are not in use and when they are to be cleaned or stripped of paint. The storage rack 70 comprises a rack assembly 72 removably mounted on a dolley 74. The dolley 74 includes a frame 76 supported by casters 78. The rack assembly 72 can be supported by the dolley 74 for movement, or it can be lifted off the dolley 74 so that it can be processed through a paint removal or cleaning operation.

While the rack assembly 72 could have other constructions, in he illustrated arrangement it includes a rectangular frame 73 adapted to nest in the frame 76 of the dolley. The frame 73 supports three vertical upright members 88 and 90 joined by a horizontal cross member 92. The horizontal cross member 92 supports a plurality of parallel, spaced apart rods 94. Each of the rods 94 is adapted to support the hooked ends 28 of a plurality of crossbars 20 such that a large number of crossbars 20 can be supported on the parallel rods 94. The vertical members 88 have upper ends 96 extending above the horizontal cross member 92 and each support a horizontally extending rod 98 which is parallel to the spaced rods 94. These rods 98 are intended to support the hooked ends 16 of stems 12 as shown in FIG. 7. While only one stem 12 is shown in FIG. 7, it will be understood that a plurality of stems 12 could be hung on each of the rods 98.

FIG. 8 illustrates a stem hanger bracket 110 for use in connecting the stem 12 to a conveyor and for providing proper orientation of the stem with respect to the conveyor. The stem hanger bracket includes a plate 112 which can depend from a conveyor and having a central elongated slot 114 adapted to receive the hook 116 of the stem. A v-shaped bracket portion 116 is welded to the rear surface of the plate to prevent backward insertion of the hook 16 of the stem into the slot 114.

Various features of the invention are set forth in the following claims.

We claim:

1. A hanger assembly for use in supporting articles to be processed and painted, the hanger assembly including:

an elongated stem having a longitudinal axis and adapted to be supported vertically during a painting operation, the elongated stem including at least one socket supported on the stem, the socket including an upwardly opening bore, the bore having a noncircular cross-section, a crossbar adapted to be supported by the stem, the crossbar including opposite ends and a key for supporting the crossbar, the key being fixed to the crossbar intermediate the opposite ends of the crossbar, and at least a portion of the key having a noncircular cross-section adapted to be housed in the bore in the socket such that the key is supported by the socket, and a plurality of hooks supported by the crossbar and spaced along the length of the crossbar whereby the hooks can support articles to be painted.

2. A hanger assembly for use in supporting articles as set forth in claim 1 wherein the key is insertable vertically downwardly into the bore of the socket to fix the crossbar to the stem and wherein the key is upwardly removable from the socket to permit separation of the crossbar from the stem.

3. A hanger assembly for use in supporting articles as set forth in claim 1 wherein one of the opposite ends of the crossbar includes hook means for use in hanging the crossbar on a storage means when the crossbar is removed from the stem.

4. A hanger assembly for use in supporting articles as set forth in claim 1 wherein the elongated stem includes a plurality of sockets spaced apart along the length of the stem and wherein the sockets each include a bore having a rectangular cross section, and wherein said portion of the key includes a cross sectional configuration complementary to said rectangular cross section of the socket such that the key will not rotate in the socket but such that the key is freely slidably removable from the socket.

5. A hanger assembly for use in supporting articles as set forth in claim 1 wherein the crossbar includes a plurality of vertically extending bores and said hooks include upper end portions housed in said bores.

6. A hanger assembly for use in supporting articles to be processed and painted, the hanger assembly including:

an elongated stem having a longitudinal axis and adapted to be supported vertically during a painting operation the elongated stem including at least one socket supported on the stem, the socket including an upwardly opening bore, the bore having a noncircular cross-section, said stem including an elongated rod having an upper end and a lower end, said upper end including hook means for hanging the stem on a support structure a crossbar adapted to be supported by the stem, the crossbar including a key for supporting the crossbar, and at least a portion of the key having a noncircular cross-section adapted to be housed in the bore in the socket such that the key is supported by the socket, and a plurality of hooks supported by the crossbar and spaced along the length of the crossbar whereby the hooks can support articles to be painted.

7. A hanger assembly for use in supporting articles as set forth in claim 6 wherein the stem includes a plurality of sockets fixed to said stem in spaced apart relation along at least a part of the length of said stem, each of said sockets having an upwardly opening bore adapted to selectively and removably house a key.

8. A hanger assembly for use in supporting articles as set forth in claim 7 and further including a masking insert housed in one of the sockets, the masking insert including a key housed in at least a portion of the socket.

9. A hanger assembly for use in supporting articles as set forth in claim 8 wherein the masking insert further includes a shield fixed to the key and surrounding a portion of the socket when the key is housed in the socket.

10. A hanger assembly for use in supporting articles to be painted, the hanger assembly including:

an elongated stem having a longitudinal axis and adapted to be supported vertically during a painting operation, the elongated stem including a plurality of sockets supported on the stem in spaced apart relation, the sockets each including an upwardly opening bore, the bore having a noncircular cross-section, a crossbar adapted to be supported by the stem, the crossbar including opposite ends and a key for supporting the crossbar, the key being fixed to the crossbar intermediate the opposite ends of the crossbar, and at least a portion of the key having a noncircular cross-section adapted to be housed in the bore in one of the sockets such that the key is supported by one of the sockets so that it will not rotate in the socket about the longitudinal axis, the key being insertable vertically downwardly into the bore of one of the sockets to fix the crossbar to the stem and the key being upwardly removable from one of the sockets to permit separation of the crossbar from the stem, and a plurality of hooks supported by the crossbar and spaced along the length of the crossbar whereby the hooks can support articles to be painted.

11. A hanger assembly for use in supporting articles as set forth in claim 10 wherein one of the opposite ends of the crossbar includes hook means for use in hanging the crossbar on a storage means when the crossbar is removed from the stem.

12. A hanger assembly for use in supporting articles as set forth in claim 10 wherein the sockets each include a bore having a rectangular cross section, and wherein said portion of the key includes a cross sectional configuration complementary to said rectangular cross section of the socket.

13. A hanger assembly for use in supporting articles to be painted, the hanger assembly including:

an elongated stem having a longitudinal axis and adapted to be supported vertically during a painting operation, the elongated stem including a plurality of sockets supported on the stem in spaced apart relation, the sockets each including a upwardly opening bore, the bore having a noncircular cross-section, a crossbar adapted to be supported by the stem, the crossbar including a key for supporting the crossbar, and at least a portion of the key having a noncircular cross-section adapted to be housed in the bore in one of the sockets such that the key is supported by one of the sockets so that it will not rotate in the socket about the longitudinal axis, the key being insertable vertically downwardly into the bore of one of the sockets to fix the crossbar to the stem and the key being upwardly removable from one of the sockets to permit separation of the crossbar from the stem, a plurality of hooks supported by the crossbar and spaced along the length of the crossbar whereby the hooks can support articles to be painted, and the crossbar including a plurality of vertically extending bores and said hooks include upper end portions housed in said bores.

14. A hanger assembly for use in supporting articles to be painted, the hanger assembly including:

an elongated stem having a longitudinal axis and adapted to be supported vertically during a painting operation, the elongated stem including a plurality of sockets supported on the stem in spaced apart relation, the sockets each including an upwardly opening bore the bore having a noncircular cross-section, said stem including an elongated rod having an upper end and a lower end, said upper end including hook means for hanging the stem on a support structure, a crossbar adapted to be supported by the stem, the crossbar including a key for supporting the crossbar, and at least a portion of the key having a noncircular cross-section adapted to be housed in the bore in one of the sockets such that the key is supported by one of the sockets so that it will not rotate in the socket about the longitudinal axis, the key being insertable vertically downwardly into the bore of one of the sockets to fix the crossbar to the stem and the key being upwardly removable from one of the sockets to permit separation of the crossbar from the stem, and a plurality of hooks supported by the crossbar and spaced along the length of the crossbar whereby the hooks can support articles to be painted.

15. A hanger assembly for use in supporting articles as set forth in claim 14 and further including a masking insert housed in one of the sockets, the masking insert including a key housed in at least a portion of the socket.

16. A hanger assembly for use in supporting articles as set forth in claim 15 wherein the masking insert further includes a shield fixed to the key and surrounding a portion of the socket when the key is housed in the socket.

17. A hanger assembly for use in supporting articles to be painted, the hanger assembly including:

an elongated stem having a longitudinal axis and adapted to be supported vertically during a painting operation, the elongated stem including a plurality of sockets supported on the stem in vertically spaced apart relation, the sockets each including an upwardly opening bore, the bore having a noncircular cross-section, a crossbar adapted to be supported by the stem, the crossbar including a key for supporting the crossbar, and at least a portion of the key having a noncircular cross-section adapted to be housed in the bore in one of the sockets such that the key is supported by one of the sockets, a plurality of hooks supported by the crossbar and spaced along the length of the crossbar whereby the hooks can support articles to be painted, and a masking insert housed in another of the sockets, the masking insert including a key housed in at least a portion of another of the sockets.

18. A hanger assembly for use in supporting articles as set forth in claim 17 wherein the masking insert further includes a shield fixed to the key of the masking insert and surrounding a portion of another of the sockets when the key is housed in another of the sockets.

19. A hanger assembly for use in supporting articles to be processed and painted, the hanger assembly including:

an elongated stem having a longitudinal axis and adapted to be supported vertically during a painting operation, the elongated stem including at least one socket supported on the stem, the socket including an upwardly opening bore, the bore having a noncircular cross-section, a crossbar adapted to be supported by the stem, the crossbar including a key for supporting the crossbar, and at least a portion of the key having a noncircular cross-section adapted to be housed in the bore in the socket such that the key is supported by the socket, a plurality of hooks supported by the crossbar and spaced along the length of the crossbar whereby the hooks can support articles to be painted, and the crossbar including a plurality of vertically extending bores and said hooks include upper end portions housed in said bores.

20. A hanger assembly for use in supporting articles as set forth claim 19 wherein said stem includes an elongated rod having an upper end and a lower end, said upper end including hook means for hanging the stem on a support structure.

21. A hanger assembly for use in supporting articles as set forth in claim 20 wherein the stem includes a plurality of sockets fixed to said stem in spaced apart relation along at least a part of the length of said stem, each of said sockets having an upwardly opening bore adapted to selectively and removably house a key.

22. A hanger assembly for use in supporting articles as set forth in claim 21 and further including a masking insert housed in one of the sockets, the masking insert including a key housed in at least a portion of the socket.

23. A hanger assembly for use in supporting articles as set forth in claim 22 wherein the masking insert further includes a shield fixed to the key and surrounding a portion of the socket when the key is housed in the socket.

* * * * *